US006708644B2

(12) United States Patent
McNamara

(10) Patent No.: US 6,708,644 B2
(45) Date of Patent: Mar. 23, 2004

(54) THERMAL IMAGING FITTING SYSTEM

(76) Inventor: Patrick McNamara, 1648 Dalton Rd., Palace Verdes Estates, CA (US) 90274

( * ) Notice: Subject to any disclaimer, the term of this patent is extended or adjusted under 35 U.S.C. 154(b) by 0 days.

(21) Appl. No.: 09/986,972

(22) Filed: Nov. 13, 2001

(65) Prior Publication Data

US 2003/0089297 A1 May 15, 2003

(51) Int. Cl.[7] ..... G01O 21/00
(52) U.S. Cl. ..... 116/207; 116/201; 116/DIG. 41
(58) Field of Search ..... 116/205, 207, 116/201, DIG. 1, DIG. 41; 374/161, 162, 106, 159; 33/3 R, 3 A, 3 B, 3 C

(56) References Cited

U.S. PATENT DOCUMENTS 3,078,182 A * 2/1963 Crone et al. ..... 116/207
3,658,543 A * 4/1972 Gerlach et al. ..... 430/343
4,003,245 A * 1/1977 Ogata et al. ..... 116/201
4,015,347 A * 4/1977 Morishita et al. ..... 36/43
4,138,357 A * 2/1979 Igarashi ..... 374/162
4,344,909 A * 8/1982 De Blauwe ..... 116/207
4,387,516 A * 6/1983 Laux ..... 36/43
4,819,644 A * 4/1989 Cheriak ..... 33/6
5,640,779 A * 6/1997 Rolloff et al. ..... 33/514.2
5,678,566 A * 10/1997 Dribbon ..... 128/779
5,733,647 A * 3/1998 Moore et al. ..... 36/43
6,241,386 B1 * 6/2001 Limburg et al. ..... 116/207
2002/0138923 A1 * 10/2002 Shaffeeullah ..... 12/142

OTHER PUBLICATIONS

US 6,290,977, 9/2001, Friars et al. (withdrawn)

* cited by examiner

*Primary Examiner*—Christopher W. Fulton
*Assistant Examiner*—Travis Reis
(74) *Attorney, Agent, or Firm*—Dimock Stratton Clarizio; Mark B. Eisen

(57) ABSTRACT

A system and method for fitting footwear and footwear inserts provides a removable insert which measures the foot by thermal imaging. The insert is provided with a thermally sensitive layer, for example a thermochromic material having a color transition interval within the range between room temperature and body temperature, that thus reacts to the heat transferred from portions of the foot in contact with the insert and temporarily changes color. The insert retains an image of the footprint for a short interval after contact with the foot, and can be removed from the footwear to examine the position and size of the foot relative to the footwear insole (and thus relative to the footwear) when the footwear is actually worn. For inserts which are purchased separately for cushioning, odor-reduction etc., the footprint image can be used as a guide to cut the footwear insert to follow the shape of an individual's foot.

5 Claims, 3 Drawing Sheets

FIG. 1.
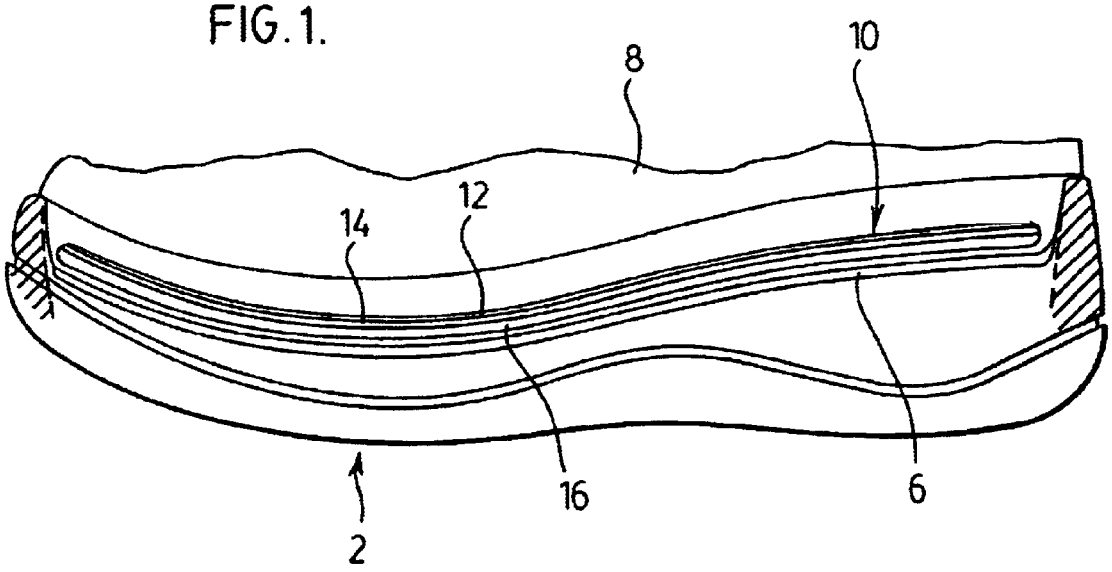
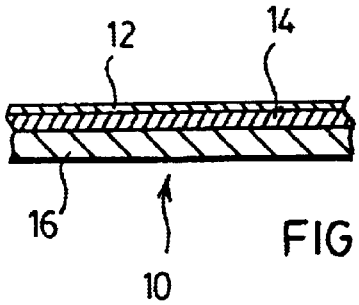
FIG. 1A.

THERMAL IMAGING FITTING SYSTEM

FIELD OF THE INVENTION

This invention relates to footwear. In particular, this invention relates to a fitting system for footwear and footwear inserts, which facilitates proper fitting thereof.

BACKGROUND OF THE INVENTION

Footwear is difficult to fit, especially in growing children. Conventionally footwear is fitted to a person's foot by measuring the foot, trying on the closest standard size of footwear, and judging by feel whether the footwear is the correct size. Children often do not have the ability to make this judgment, and an accompanying adult can only feel the position of the foot from the exterior of the footwear, which at best is an inaccurate method of judging fit. Often shortly after a footwear purchase the footwear turns out to be uncomfortable, so the purchaser returns it. As a result, footwear retailers have to either hire experienced fitting staff or handle many product returns, both of which are costly and administratively burdensome.

Systems using removable inserts have been developed to maximize the life of footwear, allowing a pair of footwear to accommodate growing feet by exchanging inserts of graduating sizes. An example of such a system is described in U.S. Pat. No. 6,092,311 issued Jul. 25, 2000 to McNamara, which is incorporated herein by reference. However, the problems that make new footwear difficult to fit properly, make it equally difficult to determine when to change to the next size of insert.

Footwear inserts are widely available for other purposes, including cushioning, odor reduction, and therapeutic purposes. Many of these inserts are made in a single large size, with printed guide lines to be followed by a user for the purpose of cutting the insert to fit the user's foot. However, feet come in so many shapes and sizes that rarely do these 'standard' guide lines closely follow the actual contours of a particular individual's foot.

There is accordingly a need for an effective system for fitting footwear, especially suitable for use by parents, caregivers and other inexperienced persons, which is easy to use and accurate. There is also a need for an effective system for fitting footwear inserts to more closely approximate the actual contours of the particular individual's foot.

SUMMARY OF THE INVENTION

The present invention overcomes these disadvantages by providing a system and method for fitting footwear and footwear inserts, which is easy to use and provides an accurate indication of foot size and shape.

The invention accomplishes this by providing a removable insert which measures the foot directly by thermal imaging. The insert is provided with a thermally sensitive layer, for example a thermochromic material, that thus reacts to heat transferred from the portions of the foot in contact with the insert, temporarily changing color. The insert retains an image of the footprint for a short interval after contact with the foot, and can then be removed from the footwear to examine the position and size of the foot relative to the footwear insole (and thus relative to the footwear) when the footwear is actually worn.

In the case of inserts which are purchased separately for cushioning, odor-reduction etc., the footprint image can be used as a guide to cut the footwear insert to follow the shape of an individual's foot.

In the preferred embodiment of the invention the thermally sensitive layer is formed from a thermochromic material having a color transition interval within the range between room temperature and body temperature. In one preferred embodiment in which the thermochromic material is colored and becomes clear when warmed, the thermally sensitive layer is applied to a light-colored supporting layer to improve the visual contrast between the heated and cooler portions of the insert.

The present invention thus provides A footwear fitting system comprising a removable insert, the insert comprising at least one supporting layer, and a thermally sensitive layer applied to a top surface of the supporting layer, whereby when in contact with a user's foot the thermally sensitive layer changes color to produce an image of the user's footprint.

The present invention further provides a method of fitting footwear, comprising the steps of: a. inserting over an insole of the footwear, a removable insert comprising a thermally sensitive layer applied to a top surface of at least one supporting layer, b. inserting a foot into the footwear, whereby when in contact with the foot the thermally sensitive layer changes color to produce an image of the user's footprint, and c. removing the insert from the footwear.

The present invention further provides a method of fitting a footwear insert comprising a thermally sensitive layer applied to a top surface of at least one supporting layer, comprising the steps of: a. applying a foot to the insert, whereby when in contact with the foot the thermally sensitive layer changes color to produce an image of a footprint, and b. cutting the insert according to the footprint image.

BRIEF DESCRIPTION OF THE DRAWINGS

In drawings which illustrate by way of example only a preferred embodiment of the invention, FIG. 1 is a cutaway elevation of footwear with an insert embodying the invention, FIG. 1A is an enlarged partial cross-section of the insert of FIG. 1.

DETAILED DESCRIPTION

Figure 2:
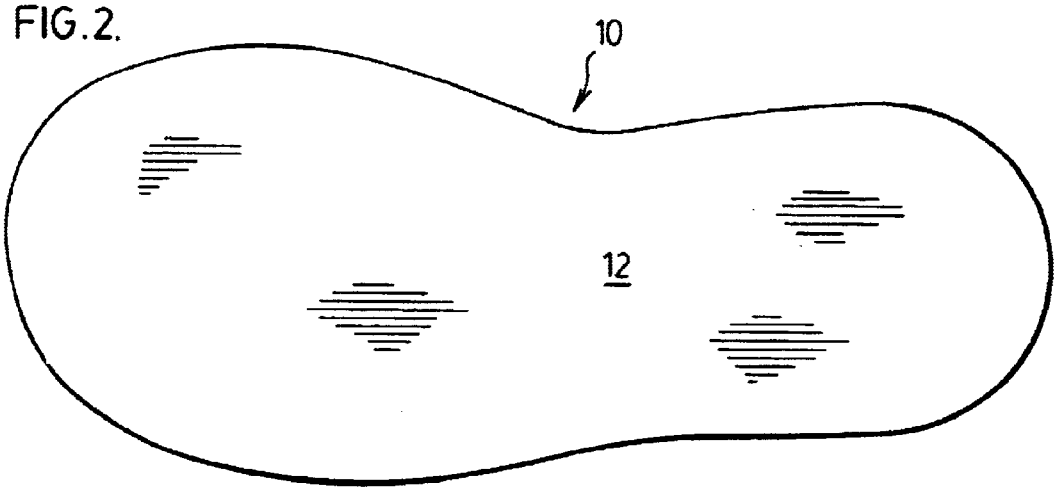
FIG. 2 is a plan view of the insert of FIG. 1 before imaging.
Figure 3:
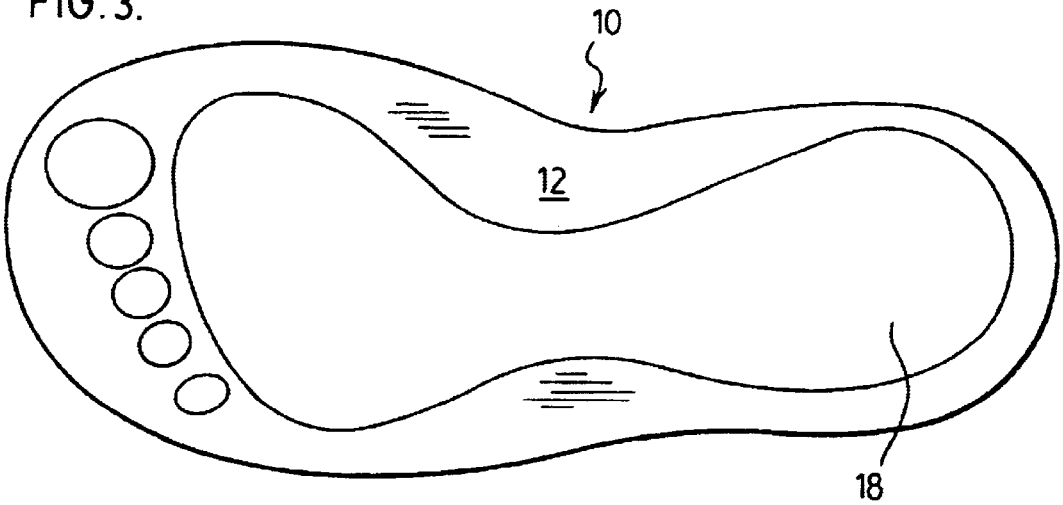
FIG. 3 is a plan view of the insert of FIG. 1 after imaging.

FIGS. 1 to 3 illustrate a first preferred embodiment of an insert 10 according to the invention. As shown in FIG. 1, the insert 10 comprises at least one supporting layer 14, supporting a layer 12 of a thermally sensitive material which reacts to warming by changing color, as is described in greater detail below. The insert 10 shown in FIG. 1 also has a cushion layer 16 for comfort, as shown in FIG. 1A, which may be glued, bonded or otherwise affixed to the supporting layer 14 in any suitable fashion, however this is optional. The supporting and cushion layers 14, 16 may also optionally be coated, impregnated or otherwise treated with conventional odor-reducing chemicals, antibacterial agents and other desired treatments.

Figure 5:
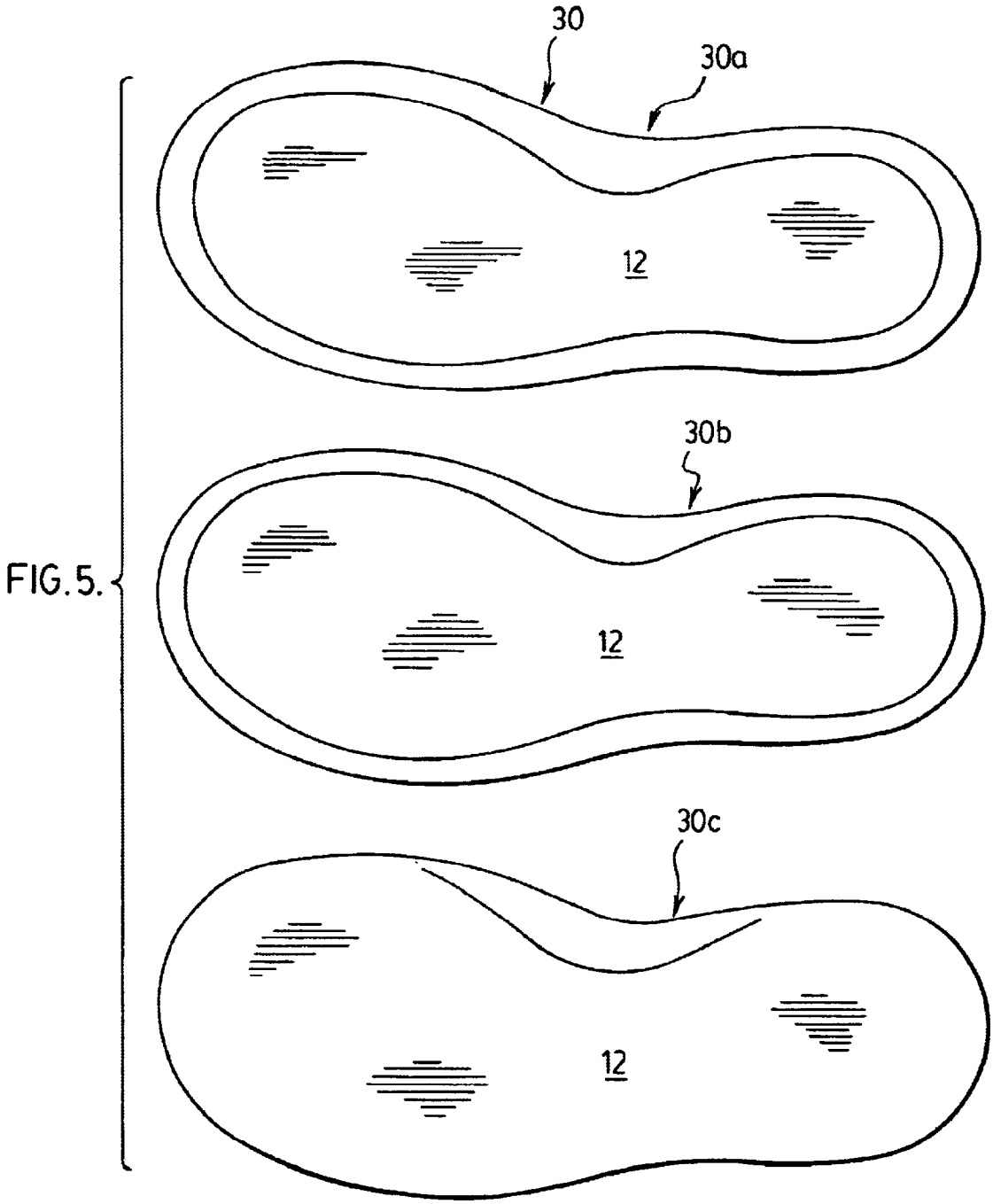
FIG. 5 is a plan view of a series of inserts embodying the invention.

FIG. 1 illustrates the insert 10 disposed over the insole 6 of footwear 2. The insert 10 may be sold with the footwear 2, or may be sold separately for use with footwear 2, either as a single insert pair or as pairs of a set of graduating inserts 30*a,* 30*b,* 30*c,* as shown in FIG. 5. As used herein footwear includes shoes, boots and the like of all types, as well as sporting equipment such as skates and ski boots, and medical and therapeutic devices worn on the foot.

Examples of suitable thermally sensitive material for the thermally sensitive layer 12 include the thermochromic materials referenced in U.S. Pat. No. 6,290,977 issued Sep. 18, 2001 to Friars et al., which is incorporated herein by reference. Such thermochromic materials have a visible color transition between room temperature (about 20 degrees C.) and body temperature (about 37 degrees C.). The invention has been found to work effectively using a thermochromic material having a color transition at a discrete temperature, preferably in the range of approximately 25 to 27 degrees C. However, the invention is not limited to any particular thermochromic material, and will work effectively with any material having a discernible color transition at any point or points in the range between approximately room temperature and body temperature.

It is possible to use any thermochromic material which changes color, including turning from colored to clear or from clear to colored, within the above-mentioned range. In the preferred embodiment the thermochromic material used for the thermally sensitive layer 12 is colored at room temperature and becomes clear in the presence of body heat, even when the heat is applied through a sock. Preferably the supporting layer 14 is light colored, most preferably white, providing a background which enhances the contrast between the colder, colored portions of the thermally sensitive layer 12 and the warmed, clear portions of the thermally sensitive layer 12. The thermally sensitive layer 12 is preferably applied over substantially the entire top surface of the supporting layer 14, and may be applied as a liquid, for example a thermochromic pigment dissolved or suspended in a liquid carrier, which can be sprayed on or otherwise applied to the supporting layer 14 to produce the thermally sensitive layer 12.

Where the thermochromic material is applied to the supporting layer 14 as a liquid, preferably the supporting layer 14 is composed of a relatively liquid impervious material, for example polyurethane (PU) or polyvinyl chloride (PVC), which allows the thermochromic material to dry as a layer on the surface of the supporting layer 14 with minimal absorption. An absorbent supporting layer 14 may also be used, but because some of the liquid will be absorbed this will typically require the application of a larger amount of the thermochromic material in order to ensure that a thermally sensitive layer 12 forms on the top surface of the supporting layer 14.

FIG. 2 illustrates the insert 10 before the application of heat, for example inserted into footwear 2 which a user is considering purchasing. The insert 10 is positioned over the insole 6, as shown in FIG. 1, with the thermally sensitive layer 12 exposed to the interior of the upper 8. When the user inserts his or her foot (not shown) into the footwear 2, the foot rests on the insert 10 in contact with the thermally sensitive layer 12. After a short interval body heat is transferred to the portions of the thermally sensitive layer 12 in contact with the foot, turning such portions clear (or a different color) and rendering an image 18 of the user's footprint which is visibly distinct from the remaining (cooler) portions of the thermally sensitive layer 12, as shown in FIG. 3.

The insert 10 is then removed from the footwear 2, and the footprint image 18 is examined to determine the position and size of the foot relative to the insole 6, which is representative of the fit of the footwear 2. The interval during which the image 18 persists after the application of heat is determined by the transition temperature of the thermally sensitive layer 12 and to some extent the heat capacity of the insert 10, which should maintain the color change long enough to allow a visual inspection of the image 18 on the insert 10.

In the case of a new footwear purchase, the purchaser can base the purchase decision on the footprint image 18. Where there is a series of graduating inserts 30, as shown in FIG. 5, the user or a caregiver can make a determination as to whether the foot has become large enough to switch to the next size of insert 30*b* or 30*c,* as the case may be.

Figure 4:
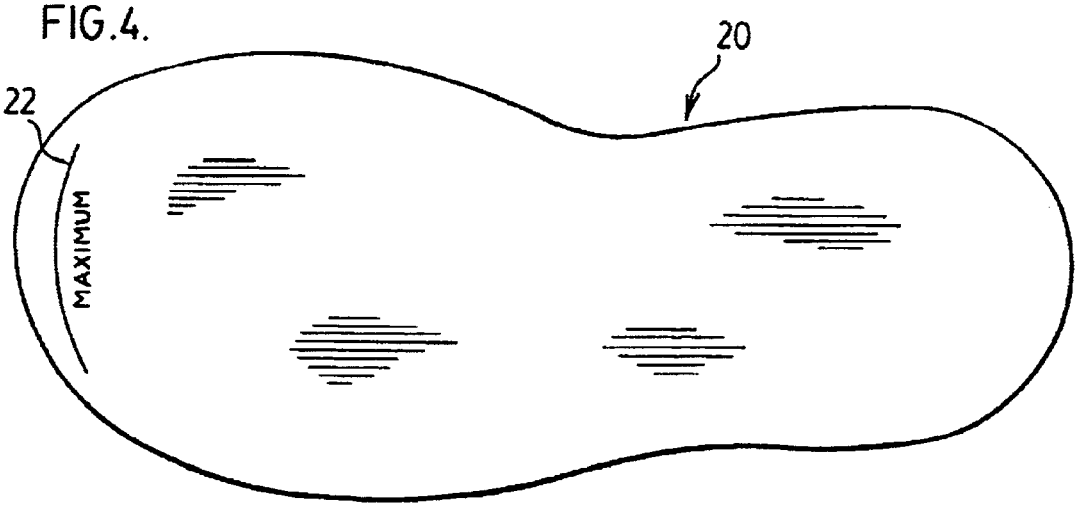
FIG. 4 is plan view of a further insert embodying the invention.

FIG. 4 illustrates an insert 20 according to the invention, which provides indicia such as markings 22 which assist a user in determining whether the footwear 2 is suitably sized, or in the case of a series of graduating inserts 30, whether the foot has become large enough to switch to the next size of insert. The markings 22 can be printed on the insert 20 in any suitable fashion, and can be positioned anywhere which provides an indication of the maximum recommended foot size for the footwear 2.

Separately purchased inserts 10, for example for cushioning, odor reduction etc., are typically purchased in a size larger than users require, in order to be cut to size by the user. In these cases, rather than following standard guide lines printed on the insert 10 the user can apply his or her foot to the insert 10, so that when in contact with the foot the thermally sensitive layer 12 changes color to produce an image 18 of the user's footprint. The user can then cut the insert according to the footprint image 10, either by or cutting directly around the footprint image 18 or by first drawing a guide line around the footprint image 18 and cutting around the guide line.

A preferred embodiment of the invention has been described by way of non-limiting example only. Those skilled in the art will appreciate that certain modifications and adaptations may be made without departing from the scope of the invention as claimed.

I claim:

1. A method of determining a fit of footwear, comprising the steps of:

a. inserting over an insole of the footwear, a removable insert having a length and width which correspond to the length and width of the footwear, said insert comprising a thermally sensitive layer applied to a top surface of at least one supporting layer, the top surface providing indicia to indicate a maximum recommended foot size in the footwear, b. inserting a foot into the footwear, whereby when in contact with the foot the thermally sensitive layer changes color to produce an image of the user's footprint, and c. removing the insert from the footwear to visually inspect the image and determine whether the image is larger than the indicia whereby if the image is larger than the indicia, then the footwear does not have the proper fit for the foot.

2. The method of claim 1 in which the supporting layer is light colored to provide a background which enhances a contrast between cold and warm portions of the thermally sensitive layer to facilitate visual inspection.

3. The method of claim 2 in which the supporting layer is white.

4. The method of claim 1 in which the thermally sensitive layer is applied over substantially the entire top surface of the supporting layer.

5. The method of claim 1 comprising a series of inserts having top surfaces of graduating sizes.

* * * * *